United States Patent [19]

Naylor et al.

[11] 4,090,386

[45] May 23, 1978

[54] METHOD OF PRODUCING ZIRCALOY TUBES

[75] Inventors: Tom D. Naylor; Ulf A. Matinlassi, both of Kennewick, Wash.

[73] Assignee: Sandvik Special Metals Corporation, Kennewick, Wash.

[21] Appl. No.: 779,529

[22] Filed: Mar. 21, 1977

[51] Int. Cl.[2] ..... B21B 19/06

[52] U.S. Cl. ..... 72/208; 72/214; 72/700

[58] Field of Search ..... 72/214, 193, 220, 208, 72/209, 370, 700

[56] References Cited

U.S. PATENT DOCUMENTS

| | | | |
|---|---|---|---|
| 1,980,186 | 11/1934 | Coe | 72/214 X |
| 3,487,675 | 1/1970 | Edstrom et al. | 72/370 |
| 3,650,138 | 3/1972 | Persico | 72/214 |

*Primary Examiner*—Milton S. Mehr

*Attorney, Agent, or Firm*—Harold L. Stults; Pasquale A. Razzano

[57] ABSTRACT

A method for producing zircaloy tubes from hollows or workpieces which are in the form of tubes having greater wall thickness than the finished tubes. The method is carried out upon a mill of the general type known as a McKay rocker which has a stationary tapered mandrel, but the mandrel is cylindrical and is moved with the workpiece.

4 Claims, 4 Drawing Figures

METHOD OF PRODUCING ZIRCALOY TUBES

This invention relates to producing zircaloy tubes from hollows, and more in particular to improved methods for producing zircaloy tubes upon a mill which has features of a prior art mill which is known as a McKay rocker. The mill used in practicing the present invention also has features disclosed in U.S. Pat. No. 3,487,675.

An object of this invention is to provide improved methods for producing high-quality zircaloy tubes. A further object is to provide for the above in a manner to permit a reduction in the time required to form finished tubes from hollows, i.e., tubes of greater wall thickness than the finished tubes. A further object is to provide for the above in a manner which overcomes difficulties encountered in the past and which permits high rates of reduction of wall thickness in forming such zircaloy tubes. These and other objects will be in part obvious and in part pointed out below.

The present invention is particularly directed toward producing zircaloy tubes of small internal diameter from cylindrical workpieces or hollows where it is desirable to have high rates of reduction in the wall thickness. It has been found that the invention permits high output rate with increased reduction rates and with less tool cost as represented by avoidance of breakage of mandrels. As compared with tubes produced by the prior McKay rocker mill, the resulting zircaloy tubes have close tolerances in outside and inside diameter and from the standpoint of ovality. Also, the tubes have a more radial grain orientation, finer grain structure, improved hydride orientation, and higher ratios of strength to ductility.

Referring to the drawings.

Figure 1:
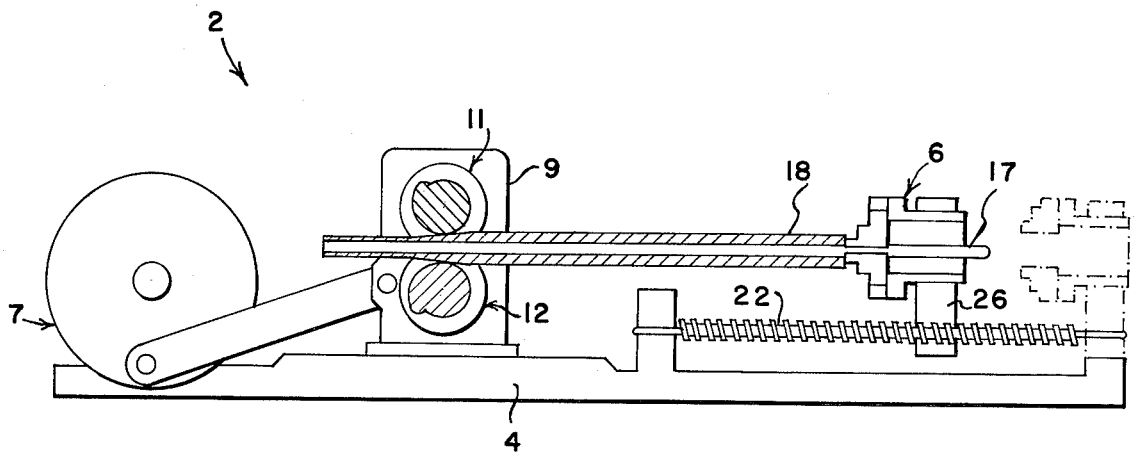
FIG. 1 is a somewhat schematic side elevation of one embodiment of the invention.

Referring to FIG. 1 of the drawing, a McKay type rocker mill 2 is represented schematically with a stationary base 4, a movable chuck 6 in which is securely clamped a tubular workpiece or hollow 18 and a cylindrical mandrel 17. The mandrel is positioned within the workpiece and has a uniform external diameter which is only slightly less than the internal diameter of the workpiece. The left-hand end of the workpiece is shown in a forming zone 33 during the forming operation which is being performed by a pair of forming rolls 11 and 12 rotatably mounted in a movable rollstand 9. Stand 9 is oscillated by a crank arm assembly 7 with the movement being such that the forming zone 33 is moved axially with respect to the workpiece.

During the forming operation, the workpiece is advanced step-by-step into and through the forming zone by a screw thread assembly having a threaded shaft 22 extending through the supporting bracket 26 for the chuck. During each step movement of the workpiece and the mandrel, the workpiece is turned about its axis a predetermined number of degrees which is not divisible into 360. That feature has significance, as will be pointed out below.

Figure 2:
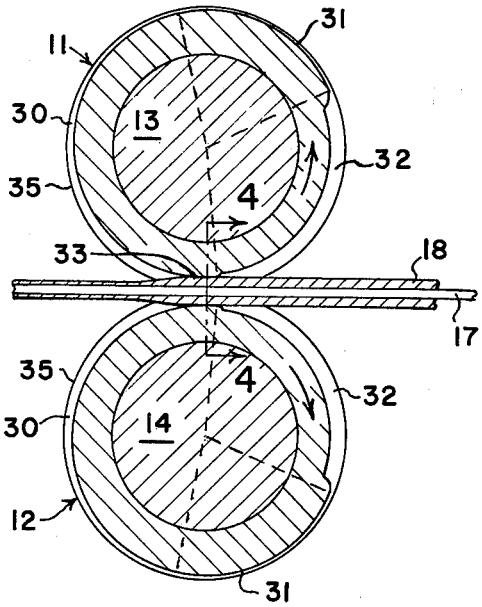
FIG. 2 is an enlarged vertical sectional view showing the tube-forming rolls of FIG. 1.
Figure 3:
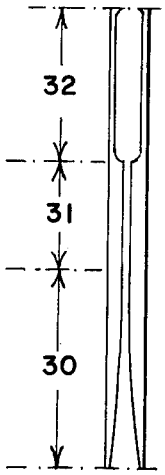
FIG. 3 is a plan view showing the groove in one of the tube-forming rolls in FIGS. 1 and 2; and, FIG. 4 is a sectional view on the line 4—4 of FIG. 2.
Figure 4:
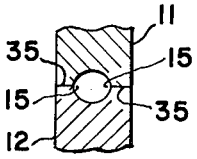

Referring now to FIGS. 2 and 3, rolls 11 and 12 are mounted upon shafts 13 and 14, respectively, and each of them has a groove (See FIG. 3) comprising a primary forming portion 30, a finishing portion 31, and a dwell portion 32. The surfaces of portions 30 and 31 of each of the grooves has a generally semi-circular cross-section the axis of which is concentric with the axis of the mandrel and the workpiece when the respective portions of the groove mate at the forming zone as shown in FIG. 4. However, each of the grooves is widened at its edges to provide a relief area 15. The peripheral edges 35 of the rolls mate along a line between the axis of the rolls which intersect the axis of the workpiece. The arc of the dwell portion 32 relative to the roll axis is usually on the order of 60–120 °. The primary forming portion 30 is usually longer than the finishing portion 31, and the dwell portion extends the remainder of the circumference of the roll.

During operation, the rollstand oscillates to the right and left from the position shown in FIG. 1, and is, in fact, moving to the left in a primary tube-forming movement of stroke. At that time, portions 30 of the grooves are engaging the workpiece, with roll 11 turning counterclockwise and roll 12 turning clockwise. The movement of the roll stand carrying the rolls relative to the rotation of the rolls is such that the finishing portions 31 of the grooves mate at their ends adjacent the dwell portions 32 when the rollstand and rolls are in the extreme left-hand position. The movements are then reversed simultaneously so that the rolls start to turn in their respective opposite directions at the same time that the rollstand starts to move the rolls to the right. Most of the reduction is normally taken on the forward stroke from the right to the left. Depending on the movement of the workpiece when the rolls roll over the workpiece, a certain amount of the deformation work can be taken during the return stroke from the left to the right.

When the rollstand approaches its extreme right-hand position, the rolls have turned so that the dwell portions 32 of the grooves are mating. At that time, a step-feed movement is produced by turning screw shaft 22 so as to feed the workpiece and the mandrel one step to the left. Simultaneously, chuck 6 rotates the workpiece the predetermined number of degrees as explained above. Each of the movements is then reversed, with the leading ends of the portions 30 of the grooves (shown at the bottom of FIG. 3) moving onto the workpiece and engaging the portion of the workpiece which has been moved into the range of the rolls by the last step advance. That produces the primary tube-forming step with the metal flowing axially along the mandrel. There is a resultant increase in tube length which projects the left-hand end of the workpiece to the left relative to the portion of the workpiece at the right and the left-hand end of the mandrel.

The respective drives to produce the movements of the workpiece and the forming rolls are known in the art. The general construction of the forming rolls is also known in the art, for example, in U.S. Pat. No. 3,487,675. The prior tube-forming mills of the McKay rocker type have stationary mandrels which are tapered. Such mills have certain drawbacks in use for producing zircaloy tubes, but they have been used commercially for that purpose. Mills of the type covered by U.S. Pat. No. 3,487,675 have also produced zircaloy tubes upon a commercial basis, and such tubes are of high quality. The present invention utilizes certain of the tube-forming principles of each of the mills referred to above. A typical prior McKay rocker mill has a tapered mandrel which is held stationary with its forward end projecting through the tube-forming zone, and the forming rolls are mounted upon a movable stand and are oscillated, illustratively, by a crank-arm arrangement. Mills of the type disclosed in U.S. Pat. No. 3,487,675 have their forming rolls supported on a stationary stand and the workpiece and a cylindrical mandrel are oscillated axially within the tube-forming zone.

The cylindrical surface of the mandrel against which the inner surface of the workpiece is compressed provides radial forces in opposition to the forces produced by the rolls against the outer surface of the workpiece. For obtaining those advantageous mechanical properties which have been mentioned earlier, a cylindrical mandrel must be used. In a pilger mill of the usual design, i.e., McKay rocker, the mandrel is stationary. Rocking on a stationary cylindrical mandrel results in high compressive radial stresses and high axial tensile stresses in the mandrel, especially if the reduction is high. If the cylindrical mandrel is fed forward, from the right to the left in FIG. 1, at the same time as the workpiece is being fed, the compressive radial forces in the mandrel will be slightly lower. The axial tensile stresses will be substantially less and the number of loading cycles on any one zone of the mandrel during the rocking of a tube will be less compared with the conditions when using a stationary mandrel. The decrease of the tensile stresses is especially important as the life length of the mandrels is on that part of the S-N fatigue curve where very small changes in stress can lead to a significant change in the mandrel life.

With a McKay rocker mill having a cylindrical (uniform diameter) mandrel 17 (see FIGS. 2 and 3), at the start of the primary tube-forming movement, an unworked portion of the workpiece has been moved to the left during the dwell period so that the leading end of groove portion 30 (shown at the bottom of FIG. 3) moves down onto the unworked portion of the workpiece. That is, the rolls have moved from their mating dwell position in which groove portions 32 straddle the workpiece, with roll 11 turning counter-clockwise and roll 12 turning clockwise. At that point, the two grooves have closed in on the workpiece (see FIG. 4) so as to compress and deform the workpiece wall. The worked end of the workpiece is tapered, and the roll grooves move down that tapered end. Coordinated with the roll turning movement, the rollstand moves the rolls to the left with a linear movement pattern which is substantially the same as the movement of the peripheral surfaces 35 around the axis of the respective rolls. Stated differently, the movement of the rollstand stops during the dwell period at the right-hand end of the stroke of the crank-arm assembly and the rotary movement of the rolls is stopped at the same time, and those movements are started in reverse at the same time and the movements accelerate together.

FIG. 1 shows the mechanism during the period of the most rapid movement from right to left, after which both movements decelerate together to the point of reversal. Therefore, the groove surfaces roll on the workpiece and push the metal from right to left in the forming zone. Except for the cold flow of the metal and the resultant movement of the metal with respect to the groove surfaces, the movements of the groove surfaces relative to the workpiece are rolling actions on the newly-formed tapered surface of the workpiece. The overall relationship is then the same as if the tapered end of the workpiece were positioned along the roll groove in FIG. 3, with the unworked workpiece at the bottom of the figure. The upper tapered end of the workpiece which is being worked has the general configuration of groove portions 30 and 31 and the finished portion extends upwardly through groove portion 32.

As indicated above, some of the metal flows to the sides of the grooves into the relief areas 15 during the forming operation. Also, the workpiece is turned around its axis a predetermined number of degrees each time that the workpiece is advanced one step into the forming zone. That turning movement is referred to as "indexing", and it moves the portions of the workpiece which are in the relief areas 15 a predetermined number of degrees from the position shown in FIG. 4. That insures uniformity in the working of the metal. Each indexing movement is a number of degrees, illustratively 35 to 80°, which does not divide evenly into 360°. Hence, even after a complete rotation of the workpiece, the orientation of the workpiece in the grooves is not exactly the same as before.

It is understood that the invention contemplates that modifications can be made in the illustrative embodiment within the scope of the claims.

We claim:

1. In a method for producing zircaloy tubes in which hydride inclusions form generally parallel to the inside and outside tube surfaces, carrying on a plurality of series of forming steps wherein each series includes the steps of, turning a pair of metal-forming rolls from a home position with the rolls having circumferential tube-forming grooves therein with tube-working surfaces which contact a cylindrical workpiece positioned between the rolls when the rolls turn through a primary tube-forming arc with said grooves positioned in mating relationship to provide a tube-forming zone, thereafter turning said rolls oppositely through a return rotation to said home position, the surface of each of said grooves in said rolls being generally arcuate in cross-section throughout and having a forming portion with a continuous surface which has an arcuate cross-section throughout with the radius of the arc decreasing longitudinally of the groove from a first zone to a second zone and with the groove extending from said second zone to a third zone as a finishing portion of said groove in which said substantially arcuate surface has substantially the radius of said surface at said second zone, said groove having a dwell portion extending between said first zone and said third zone within which said rolls do not contact a workpiece, advancing a cylindrical workpiece axially by controlled steps into and through said tube-forming zone, moving a substantially cylindrical mandrel within the workpiece simultaneously with each of said advancing steps of said workpiece with the diameter of the mandrel being substantially the internal diameter of said workpiece, said workpiece having an external radius which is substantially the same as the radius of said arc of said tube-working surface at said first zone and the axis of said workpiece being concentric with the axis of said surfaces of said grooves, moving said rolls together as a unit axially of the workpiece with an oscillating movement through a forward step relative to said tube-forming zone precisely counter to the direction of said step movement of said workpiece and mandrel and thereafter through a return step in the opposite direction and for the same distance, synchronizing the rotation and movement of said rolls and the movements of said workpiece so that each movements of the workpiece and the mandrel occurs when said dwell portions of said grooves are in mating relationship, and so that said first zones of said grooves engage a workpiece simultaneously within said tube-forming zone with the start of said primary tube-forming rotation of said rolls and with the circumferential rate of movement of said grooves along the workpiece being substantially the same as the rate of movement of said rolls axially of the workpiece whereby said rolls rotate said tube-working surfaces in contact with the workpiece to produce a rolling action of said surfaces of said grooves along the workpiece due to the synchronous rotation of said rolls and the movement of the rolls axially of the workpiece.

2. The method as described in claim 1, wherein the workpiece is a cylindrical tube having a wall thickness which is substantially greater than the wall thickness of the finished tube and wherein the inside diameter of the workpiece is substantially the same as the inside diameter of the finished tube.

3. In a method for producing zircaloy tubes in which hydride inclusions form generally parallel to the inside and outside tube surfaces, carrying on a plurality of series of forming steps wherein each series includes the following:

(a) advancing a cylindrical workpiece of a predetermined external radius axially by controlled steps into and through a tube-forming zone;

(b) turning a pair of metal-forming rolls from a home position with the rolls having circumferential tube-forming grooves therein with tube-working surfaces which contact a tubular workpiece positioned between the rolls when the rolls turn through a primary tube-forming arc with said grooves positioned in mating relationship within said tube-forming zone;

(c) turning said rolls oppositely through a return rotation to said home position;

(d) moving a mandrel with a substantially cylindrical outer surface within the workpiece simultaneously with each of said advancing steps of said workpiece, the diameter of said mandrel being substantially the internal diameter of said workpiece, said workpiece having an external radius which is substantially the same as the radius of said arc of said tube-working surface at said first zone and the axis of said workpiece being concentric with the axis of said surface of said grooves;

(e) moving said rolls together as a unit with an oscillating movement through a forward step movement in the same direction as said step movement of said workpiece and mandrel and thereafter through a return step in the opposite direction and for the same distance; and, (f) synchronizaing the rotation and movement of said rolls and the movements of said workpiece and mandrel whereby each of said steps and turning movements of said workpiece occurs when said dwell portions of said grooves are in mating relationship; and whereby said first zones of said grooves engage a workpiece simultaneously within said tube-forming zone with the start of said primary tube-forming rotation of said rolls and with the circumferential rate of movement of said grooves being substantially the same as the rate of movement of said rolls axially of the workpiece whereby said rolls rotate in contact with the workpiece due to the synchronous rotation of said rolls and the movement of the rolls axially of the workpiece.

4. In a method for producing zircaloy tubes in which hydride inclusions form generally parallel to the inside and outside tube surfaces, the steps of, placing a cylindrical workpiece onto a cylindrical mandrel with the mandrel having a diameter whereby it is snugly received in the workpiece, said workpiece having a cylindrical outer surface of predetermined radius, supporting the workpiece and the mandrel together at one end of the workpiece and with the other end of the workpiece in alignment with a tube-forming zone, and carrying on a plurality of series of forming steps wherein each series includes the following:

(a) moving the workpiece and the mandrel axially together one advancing step whereby the other end of the workpiece moves into a tube-forming zone a predetermined distance and an advanced length of the workpiece enters said tube-forming zone;

(b) positioning a pair of mating tube-forming rolls in a home position during said advancing step, said rolls having mirrorimage arcuate peripheral grooves which mate at said tube-forming zone to produce a tube-forming cavity which is substantially circular with its axis substantially concentric with the axis of the external surface of the workpiece, each of said rolls having an arcuate dwell portion between the ends of its groove and being formed at said dwell portion such that the roll does not engage the workpiece when in said home position, each of said grooves being substantially semicircular in cross-section and generally tapered from the end adjacent said dwell portion where it has a radius which is substantially the radius of said outer surface of the workpiece and being of progressively reduced radius through a major tube-forming zone to a radius which is of the order of the radius of the outer surface of the finished tube, each of said grooves having a tube-finishing zone within which said radius is substantially uniform and which extends from said major tube-forming portion to said dwell portion;

(c) simultaneously moving and rotating said rolls with said moving being parallel to the axis of the workpiece and of a distance which is greater than the length of said major tube-forming zone of said grooves plus a predetermined length of said tube-finishing zone whereby said tube-forming cavity between said rolls is reduced from its maximum radius to its minimum radius during said movement, and said rotating of said rolls being through an arc and at a rate to maintain said grooves in a substantially non-slipping relationship with respect to the tube surfaces which are contacted within said tube-forming cavity, whereby said rolls engage said advanced length of the workpiece and move progressively in said advancing direction toward said other end of the workpiece; and, (d) simultaneously reversing said moving and rotating of said rolls to return them to said home position, whereby said lengths of said finishing portions of said grooves move back along the workpiece and said major tube-forming portions of said grooves then move back along said workpiece to the position wherein said dwell portions of said rolls are in mating relationship within said tube-forming zone.

* * * * *